US005421393A

United States Patent [19]

Wolfe

[11] Patent Number: 5,421,393

[45] Date of Patent: Jun. 6, 1995

[54] SHOWER CURTAIN EDGE STAY

[76] Inventor: Michael Wolfe, 101 W. 90th St., New York, N.Y. 10024

[21] Appl. No.: 201,722

[22] Filed: Feb. 25, 1994

Related U.S. Application Data

[63] Continuation of Ser. No. 979,239, Nov. 20, 1992, abandoned.

[51] Int. Cl.[6] ..... A47H 1/00

[52] U.S. Cl. ..... 160/349.1; 160/DIG. 6

[58] Field of Search ..... 160/349.1, 349.2, 330, 160/DIG. 6, 405; 4/558, 580, 608

[56] References Cited

U.S. PATENT DOCUMENTS

| | | | |
|---|---|---|---|
| 1,476,887 | 12/1923 | Heerey | 160/349.2 X |
| 2,148,401 | 2/1939 | Ellis, Jr. | 4/149 |
| 2,212,326 | 8/1940 | Piken | 160/349.1 X |
| 2,239,630 | 4/1941 | Tendrich et al. | 160/DIG. 6 |
| 2,242,478 | 5/1941 | Pekarz | 160/349.2 X |
| 2,620,870 | 12/1952 | Brennan | 160/349.2 |
| 2,712,354 | 7/1955 | Margolies | 160/330 |
| 2,776,439 | 1/1957 | Rondinelli | 160/349.1 X |
| 2,821,248 | 3/1958 | Solow et al. | 160/330 |
| 2,827,959 | 1/1958 | Irvine | 160/370.2 R |
| 3,093,877 | 6/1963 | Roberts | 160/330 |
| 3,107,361 | 10/1963 | Glutting | 160/349.1 X |
| 3,338,292 | 8/1967 | Goodman | 160/349.1 |
| 3,365,684 | 1/1968 | Stemke et al. | 335/302 |
| 3,639,919 | 2/1972 | White | 4/149 |
| 3,879,806 | 4/1975 | Armstrong | 24/73 CH |
| 3,934,636 | 1/1976 | Simmons | 160/349 R |
| 4,070,735 | 1/1978 | Canaday | 160/DIG. 6 X |
| 4,077,072 | 3/1978 | Dezura | 4/149 |
| 4,088,174 | 5/1978 | Edwards | 160/349 R |
| 4,361,915 | 12/1982 | Siewert | 4/558 X |
| 4,594,741 | 6/1986 | Payne | 4/558 |
| 4,723,326 | 2/1988 | Tarlow et al. | 4/608 |
| 4,759,087 | 7/1988 | Zeilinger | 4/605 |
| 4,825,481 | 5/1989 | Lonberger | 4/608 |
| 4,944,050 | 7/1990 | Shames et al. | 4/609 |
| 5,023,964 | 6/1991 | Unsworth . | |
| 5,070,551 | 12/1991 | Harrison et al. | 4/608 |
| 5,148,580 | 9/1992 | Dyckow | 24/303 |

*Primary Examiner*—David M. Purol

*Attorney, Agent, or Firm*—Elizabeth Barnhard; David M. Klein; Bryan Cave

[57] ABSTRACT

A shower curtain edge stay to prevent a shower curtain from curling inward. The edge stay in one embodiment is a stiffened longitudinal rib member disposed in the shower curtain adjacent to a lower vertical side edge of the shower curtain and extending parallel to a horizontal edge of the shower curtain.

16 Claims, 1 Drawing Sheet

SHOWER CURTAIN EDGE STAY

This is a continuation of U.S. application Ser. No. 07/979,239, filed Nov. 20, 1992, now abandoned.

BACKGROUND OF THE INVENTION

This invention relates to improvements in shower curtains, liners, and similar closures, and more particularly to the inclusion of elements in or onto a curtain or liner to prevent the curling in of the side edge of the curtain.

It is found that after some use, many shower curtains or their interior linings tend to curl inward at their side edge and stick to itself. The sticking together of the curtain material is usually caused by a water film initially and later by a combination of water and/or soap film. The curling then causes shortening of the shower curtain, or liner, and tends to happen at the lower part of the side edge. When this occurs, a gap opens up between the curtain and the wall allowing water to escape from the shower stall or tub area. The terms curtain and liner are used interchangeably in the present application.

In many curtains or liners, intended for showers in bathtubs, magnets have been added along the bottom that are intended to cling to the bathtub. Magnets help keep the shower curtain or liner from moving about when hit by shower spray or affected by air currants. This is not enough however, to keep the curtains from curling inward at the sides and causing the gap where water splashes out. Shower stall curtains usually do not have magnets.

There are also devices which are intended for closure of the curtain which require fastening devices that are attached to adjacent walls. However there are no devices, known to the applicant, which are integrally formed or attached to a curtain for the purpose of preventing the side edge of the curtain from curling in upon itself.

SUMMERY OF THE INVENTION

The present invention is a shower curtain having a stiffened rib disposed approximate to or selectively attachable to a lower outer side edge of the curtain. An object of this invention is to include elements, such as ribs, stays or other attachment devices, placed in or on a shower curtain or liner so that the sides of the shower curtain do not curl inward upon and stick to itself and thus shortens the width of the shower curtain. The means and advantage of this invention would thus help prevent a gap from occurring at the lower sides of the curtain or liner, thus help preventing water from escaping the shower enclosure.

Additional advantages of this invention include, that no additional parts, attachments or assembly are required for its functioning, and that this invention permits the folding flat with no additional space required in packaging.

This invention could be incorporated with a curtain separately, or in combination with other devices which are intended for closure or diversion of splash water back into the water receptacle.

This invention could also be used in other environments and purposes such as spray booths, air curtains, and the like.

DESCRIPTION OF THE PREFERRED EMBODIMENTS

Figure 1:
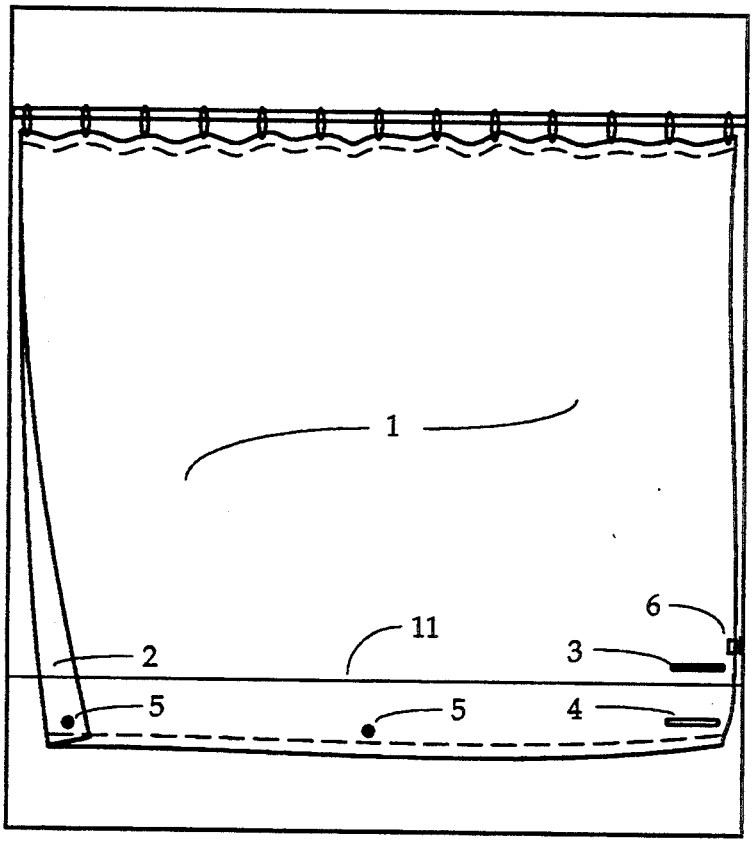
FIG. 1 is an elevation view of a shower curtain or liner hung in a bathtub space showing the left edge of the curtain curled over.
Figure 2:
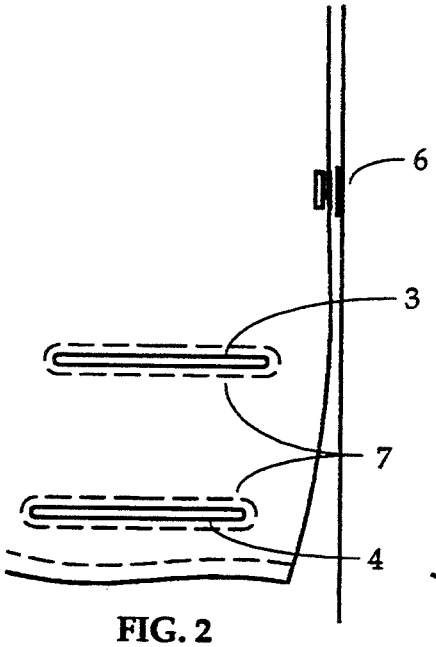
FIG. 2 is a detail of the lower right edge of the curtain.

FIG. 1 shows an elevation view of a shower curtain or liner 1 with a curled in edge on the left side 2 and an embodiment of an incorporated rib stay 3 which would span the area that usually curls in on itself.

A preferred embodiment of rib 3 would be a substantially rectangular, approximately ¼ inch wide by approximately 6 inches long (so that they do not interfere with the folding of the curtain in typical packaging) and be of a thin yet sturdy stiffened material preferably plastic. In the case of a tub enclosure, the preferred embodiment would consist of this stiffened rectangular rib disposed in a lower portion of said curtain adjacent to a vertical side edge. The placement of the stay would start anywhere from the bottom of the curtain to approximately 2" above the tub line and close to the side edge of the curtain. A second stay 4 could be located towards the lower edge of the curtain and could itself be a magnetic strip. It is intended that both sides of the curtain would be fitted with at least a single stay, or multiple stays.

Typical curtain magnets are shown 5 as well as wall closure attachments such as "velcro" tabs at 6 or other closure attachments could be used in conjunction with the stays but are not necessary for the functioning of this invention.

Figure 3:
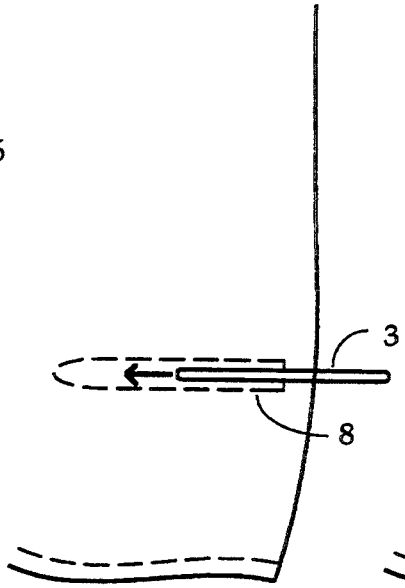
FIG. 3 shows an edge stay that slides into a sleeve formed in the curtain.

The inclusion of an integral rib could be by placement of the rib on the curtain and a patch of material 7 (usually the same material as the curtain) placed over the rib, and as in the case of a plastic curtain the patch then heat fused to the curtain. The ribs could also be of some design element, in that many curtains are transparent, or translucent. Further, as in the case of a cloth type curtain, a rectangular rib may be selectively disposed in a sleeve 8 of FIG. 3 formed in the shower curtain.

Figure 4:
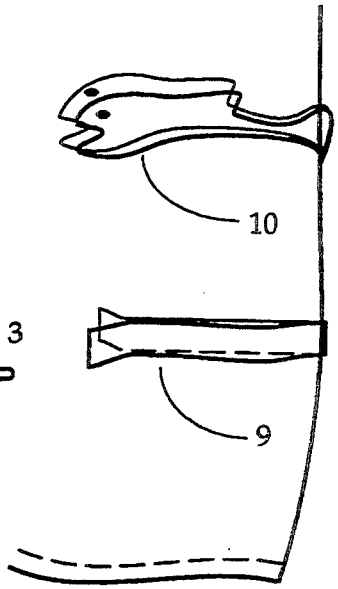
FIG. 4 shows an edge stay clip for selective attachment.

Another embodiment is an externally attached stay such as shown 9 of FIG. 4 which is a clip like device slid onto the lower side of the curtain. This external clip would have spring tension between its two sides which would cause a friction grip to the curtain. This embodiment could be of any material which would be waterproof and be able to sustain a spring tension such as plastic or metal or a combination thereof. This external stay clip could also include some design element.

Therefore, in view of the foregoing I claim:

1. An improved shower curtain of the type having a shower rod attachment means disposed at a top horizontal portion thereof, a pair of side edges, and a bottom edge, wherein the improvement comprises:

a non-magnetic lightweight stiffening rib member disposed toward the bottom edge and adjacent to at least one of the side edges of the shower curtain, the stiffening rib member having a lengthwise edge oriented horizontally relative to the bottom edge of the shower curtain, wherein the lengthwise edge of the stiffening rib member is sized for preventing the side edge of the shower curtain from folding over, and wherein the weight of the stiffening rib member does not substantially contribute to preventing the side edge of the shower curtain from folding over.

2. The improved shower curtain according to claim 1, wherein the stiffening rib member is ¼" wide and 6" long.

3. The improved shower curtain according to claim 1, wherein the stiffening rib member is fixedly attached to the shower curtain.

4. The improved shower curtain according to claim 3, wherein the stiffening rib member is secured to the shower curtain by securing material fixedly attached to the shower curtain over the stiffened rib member.

5. The improved shower curtain according to claim 1, wherein the stiffening rib member is removably attachable to the shower curtain.

6. The improved shower curtain according to claim 5, wherein the stiffening rib member is a substantially U-shaped clip comprising a pair of opposed, resiliently biased members, the U-shaped clip being attachable to and removable from the shower curtain for removably securing the shower curtain between the opposed, resiliently biased members.

7. A method of preventing a lower side edge of a shower curtain from curling inward, comprising the steps of:

(a) providing a magnetic or non-magnetic lightweight stiffening, longitudinal rib member comprising a lengthwise edge sized to prevent the lower side edge of the shower curtain from curling when the stiffening rib member is attached to the shower curtain adjacent to the lower side edge and oriented substantially horizontally, wherein the weight of the stiffening rib member does not substantially contribute to preventing the side edge of the shower curtain from folding over; and (b) attaching the stiffening, longitudinal rib member adjacent to the lower side edge of the shower curtain and oriented horizontally.

8. The method according to claim 7, wherein the stiffening rib member is fixedly attached to the shower curtain.

9. The method according to claim 8, wherein the step of fixedly attaching the stiffening rib member comprises:

(a) providing a securing material sized to cover the stiffened member; and (b) securing the securing material to the shower curtain over the stiffened rib member.

10. The method according to claim 9, wherein the securing material is the same material as the shower curtain.

11. The method according to claim 7, wherein the step of attaching the stiffening rib member comprises removably attaching the stiffening rib member to the shower curtain.

12. The method according to claim 7, wherein the stiffening rib member is a substantially U-shaped clip comprising a pair of opposed, resiliently biased members, and the step of attaching the stiffening rib member comprises inserting the shower curtain between the opposed, resiliently biased members.

13. The method of claim 12, further comprising the step of removing the shower curtain from between the opposed, resiliently biased member.

14. The method according to claim 11, wherein the step of removably attaching the stiffening rib member comprises:

(a) providing a securing material sized to support the stiffening member;

(b) securing the material to the shower curtain for forming a pocket, the pocket being sized to enable the stiffening rib member to be insertable therein and removable therefrom, and the pocket being oriented for enabling the stiffening rib member to be secured therein and oriented substantially horizontally; and (c) inserting the stiffening rib member in the pocket.

15. A method according to claim 12, further comprising the step of removing the stiffening rib member from the stiffening pocket.

16. An improved shower curtain of the type having a shower rod attachment means disposed at a top horizontal portion thereof, a pair of side edges, and a bottom edge, wherein the improvement comprises:

a magnetic or non-magnetic stiffening lightweight rib member disposed toward the bottom edge and adjacent to at least one of the side edges of the shower curtain, the stiffening rib member having a lengthwise edge oriented horizontally relative to the bottom edge of the shower curtain, wherein the lengthwise edge of the stiffening rib member is sized for preventing the side edge of the shower curtain from folding over, and wherein the weight of the stiffening rib member does not substantially contribute to preventing the side edge of the shower curtain from folding over.

* * * * *